US010219608B2

(12) United States Patent
Ball

(10) Patent No.: US 10,219,608 B2
(45) Date of Patent: Mar. 5, 2019

(54) SKATEBOARD BACKPACK

(71) Applicant: Steven T. Ball, Newport, NH (US)

(72) Inventor: Steven T. Ball, Newport, NH (US)

( * ) Notice: Subject to any disclaimer, the term of this patent is extended or adjusted under 35 U.S.C. 154(b) by 0 days.

(21) Appl. No.: 15/451,749

(22) Filed: Mar. 7, 2017

(65) Prior Publication Data

US 2017/0251791 A1 Sep. 7, 2017

Related U.S. Application Data

(60) Provisional application No. 62/304,529, filed on Mar. 7, 2016.

(51) Int. Cl.

| | |
|---|---|
| ***A45F 3/08*** | (2006.01) |
| ***A45F 3/00*** | (2006.01) |
| ***A45F 3/04*** | (2006.01) |
| ***A63C 17/00*** | (2006.01) |
| *A45C 13/40* | (2006.01) |
| *A45C 15/06* | (2006.01) |

(52) U.S. Cl.

CPC ..... *A45F 3/00* (2013.01); *A45F 3/04* (2013.01); *A63C 17/0006* (2013.01); *A45C 13/40* (2013.01); *A45C 15/06* (2013.01); *A45F 2003/001* (2013.01); *A45F 2003/003* (2013.01)

(58) Field of Classification Search

CPC ..... A45F 2003/003; Y10S 224/007; Y10S 224/917; A63C 2203/44

USPC ..... 224/645, 650, 575, 576

See application file for complete search history.

(56) References Cited

U.S. PATENT DOCUMENTS

| | | | | |
|---|---|---|---|---|
| 4,790,460 | A | 12/1988 | Harper, Jr. | |
| 5,016,794 | A | 5/1991 | Beagle, Jr. | |
| 5,092,506 | A | 3/1992 | Bolduc | |
| 5,419,473 | A * | 5/1995 | Lamar | A63B 55/00 224/632 |
| 5,573,166 | A * | 11/1996 | Leja | A45F 3/04 224/630 |
| 6,536,639 | B1 | 3/2003 | Frank | |
| 6,832,711 | B2 | 12/2004 | Black | |
| 7,431,311 | B2 * | 10/2008 | Turner | A45F 3/04 190/18 A |
| 8,201,837 | B2 | 7/2012 | Dweek | |
| 9,089,199 | B1 * | 7/2015 | Taylor | A45C 13/02 |
| 9,113,696 | B2 * | 8/2015 | Quartarone, III | A45F 3/04 |

(Continued)

FOREIGN PATENT DOCUMENTS

WO 2013187903 A1 12/2013

OTHER PUBLICATIONS

Blind Chic Scumbag Backpack | Uncrate. Product Listing [online]. Uncrate LLC 2018. [Retrieved on Nov. 10, 2014.] <URL: http://uncrate.com/stuff/blind-chic-scumbag-backpack/>.

(Continued)

*Primary Examiner* — Adam J Waggenspack

(74) *Attorney, Agent, or Firm* — Cramer Patent & Design, PLLC; Aaron R. Cramer

(57) ABSTRACT

A backpack has a folding durable panel attached to the back side thereof. The panel is configured to wrap around a middle portion of a skateboard deck, such that the trucks and wheels positioned away from the back of the wearer. The skateboard is secured to the backpack by an attachment means attached to the ends of the fabric panel.

16 Claims, 9 Drawing Sheets

(56) References Cited

U.S. PATENT DOCUMENTS

| | | | | |
|---|---|---|---|---|
| 2003/0234269 | A1* | 12/2003 | Shamas | A43B 5/0425 224/576 |
| 2004/0238585 | A1 | 12/2004 | Scarano | |
| 2008/0251550 | A1* | 10/2008 | Tong | A45C 13/02 224/153 |
| 2015/0034402 | A1* | 2/2015 | Dourado | A45F 3/04 180/181 |
| 2015/0157113 | A1* | 6/2015 | Anelevitz | A45F 3/04 224/576 |
| 2016/0339327 | A1* | 11/2016 | Bozinoff | A63C 11/10 |
| 2016/0360871 | A1* | 12/2016 | Schessel | A45F 5/00 |

OTHER PUBLICATIONS

Blind Chic per Lokal Skateshop: Backpack. Product Listing [online]. Pigmag [Retrieved on Nov. 10, 2014.] <URL:http://www.pigmag.com/it/2012/06/29/blindchicperlokalskateshopbackpack/>.

Spitfire Wheels Spitfire Bighead Skate Backpack Black Spitfire Wheels from Native Skate Store UK. Product Listing [online]. 2018 Native Skate Store. [Retrieved on Nov. 10, 2014.] <URL: http://www.nativeskatestore.co.uk/accessoriesc3/skatebackpacksbagsc28/spitfirebigheadskatebackpackblackp6957>.

* cited by examiner

SKATEBOARD BACKPACK

RELATED APPLICATIONS

This application is a Continuation-in-part and claims the benefit of U.S. Provisional Application No. 62/304,529 which was filed Mar. 7, 2016, the entire disclosures of which are incorporated herein by reference.

FIELD OF THE INVENTION

The present invention relates generally to the field of backpacks and more specifically relates to a skater pack system.

BACKGROUND OF THE INVENTION

Many people enjoy skateboarding. Numerous areas are available to skateboarders such as a skateboard specific recreational areas. In addition, skateboarding is a useful means of transportation that is low cost and low maintenance. There are areas where skateboarding is restricted, and the skateboard must be carried by the rider. This can be cumbersome to carry in these areas, especially if the area is crowded, such as public transportation. Placing a skateboard in a backpack may cause damage to the board and wheels, as well as the backpack. A precariously placed skateboard may fall, also causing damage to the board.

Jamming a skateboard in a backpack and the inability to remove the backpack while riding full public transportation, may cause serious strain and back fatigue due to the inability to align the skateboard properly to the back. Also, carrying the skateboard in this manner may damage the small components connecting the wheels and trucks. It is therefore desirable to design a way to carry a skateboard in a backpack.

Various attempts have been made to solve problems found in the backpack art. Among these are found in: U.S. Pat. No. 6,832,711 to Bradley Thomas Black; U.S. Pat. No. 8,201,837 to Steven Dweek; and U.S. Pat. No. 5,016,794 to Donald L. Beagle Jr. These prior art references are representative of a skateboard backpack system.

None of the above inventions and patents, taken either singly or in combination, is seen to describe the invention as claimed. Thus, a need exists for a reliable skateboard backpack system, and to avoid the above-mentioned problems.

SUMMARY OF THE INVENTION

The principles of the present invention provide for a backpack, comprising a backpack body which has a pair of sides, a front side, a top side, a bottom side, and a rear side, and at least one compartment, each accessible via a backpack fastener; a pair of shoulder straps with each strap having distal ends affixed to aligned upper and lower positions on the rear side and adjacent to one (1) of the pair of sides, a chest strap which is capable of removably attaching to and spanning a distance between the pair of shoulder straps and an attachment pad which is affixed to the rear side between the pair of shoulder straps. The attachment pad is capable of enveloping and securing a skateboard against the rear side. In a separate embodiment, the backpack may also comprise a pair of wheel recesses located on opposing upper and lower locations of the rear side and a pair of truck recesses, each of which are an extension of an individual wheel recess. Each pair of wheel recesses are capable of receiving at least a portion of a wheel of a skateboard while each pair of truck recesses are capable of receiving at least a portion of a truck of a skateboard.

The backpack may also have a handle which is located on the top side, a carabiner which located on the top side, adjustable strap which is located on each of the pair of sides, an elastic netting located on each of the pair of side, a pouch located on the front side, an illuminating device removably attached to the front side or the chest strap, a foam insert which is capable of being placed within the attachment pad and an adjustable comfort pad associated with the attachment pad.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
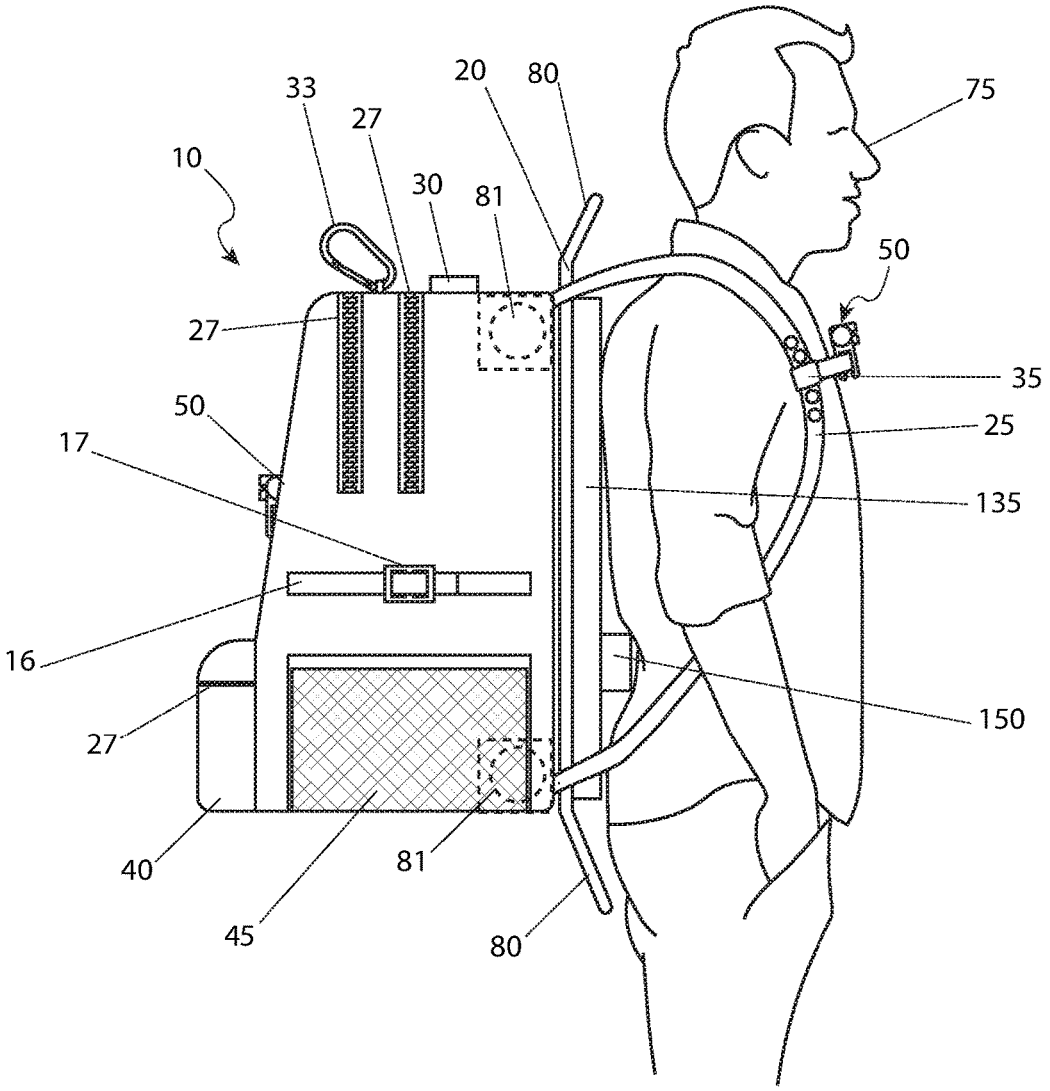
FIG. 1 is an environmental view of a backpack 10 holding a skateboard 80 on the back of a user 75, according to an embodiment of the present invention.

10 backpack
16 side strap
17 side strap buckle
20 attachment pad
25 shoulder strap
27 zipper
30 handle
31 cushion
32 carabiner
35 chest strap
**36*a*** first fastener
**36*b*** second fastener
37 loop
38 chest strap buckle
40 pouch
45 netting
47 truck recess

48 wheel recess
50 illumination device
75 user
80 skateboard
81 wheel
82 truck
100 molded frame
105 hook-and-loop wheel securement system
101 upper pocket
102 lower pocket
110 notches
115 first side of hook-and-loop fastener
120 second side of hook-and-loop fastener
125 hard foam spacer
130 direction arrow
135 foam cradle pad
140 opening
145 travel path
150 lumbar pad
160 first knob
165 second knob
170 light bulb
175 clip
180 light bulb housing

DETAILED DESCRIPTION OF THE PREFERRED EMBODIMENT

The best mode for carrying out the invention is presented in terms of its preferred embodiment, herein depicted within FIG. 1 through 10. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention is directed to a backpack 10 capable of holding and securing a skateboard 80 and capable of being worn by a user 75. In one (1) embodiment, the backpack 10 may comprise a rear section with an attachment pad 25 attached thereto for securing a skateboard 80, a front section with standard backpack components, and a pair of elongated shoulder straps 25 for accommodating the length of a skateboard 80.

Figure 2:
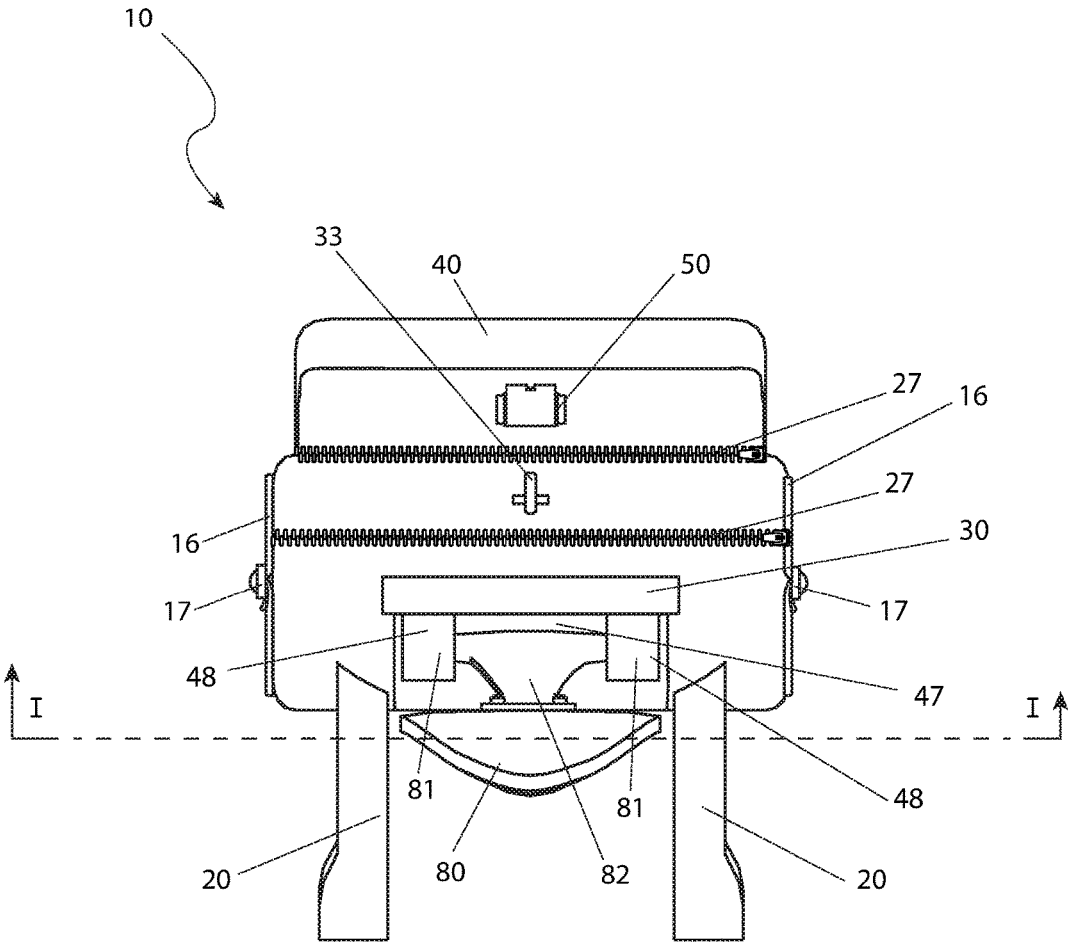
FIG. 2 is a top view illustrating the backpack 10 holding a skateboard 80, according to an embodiment of the present invention.
Figure 3:
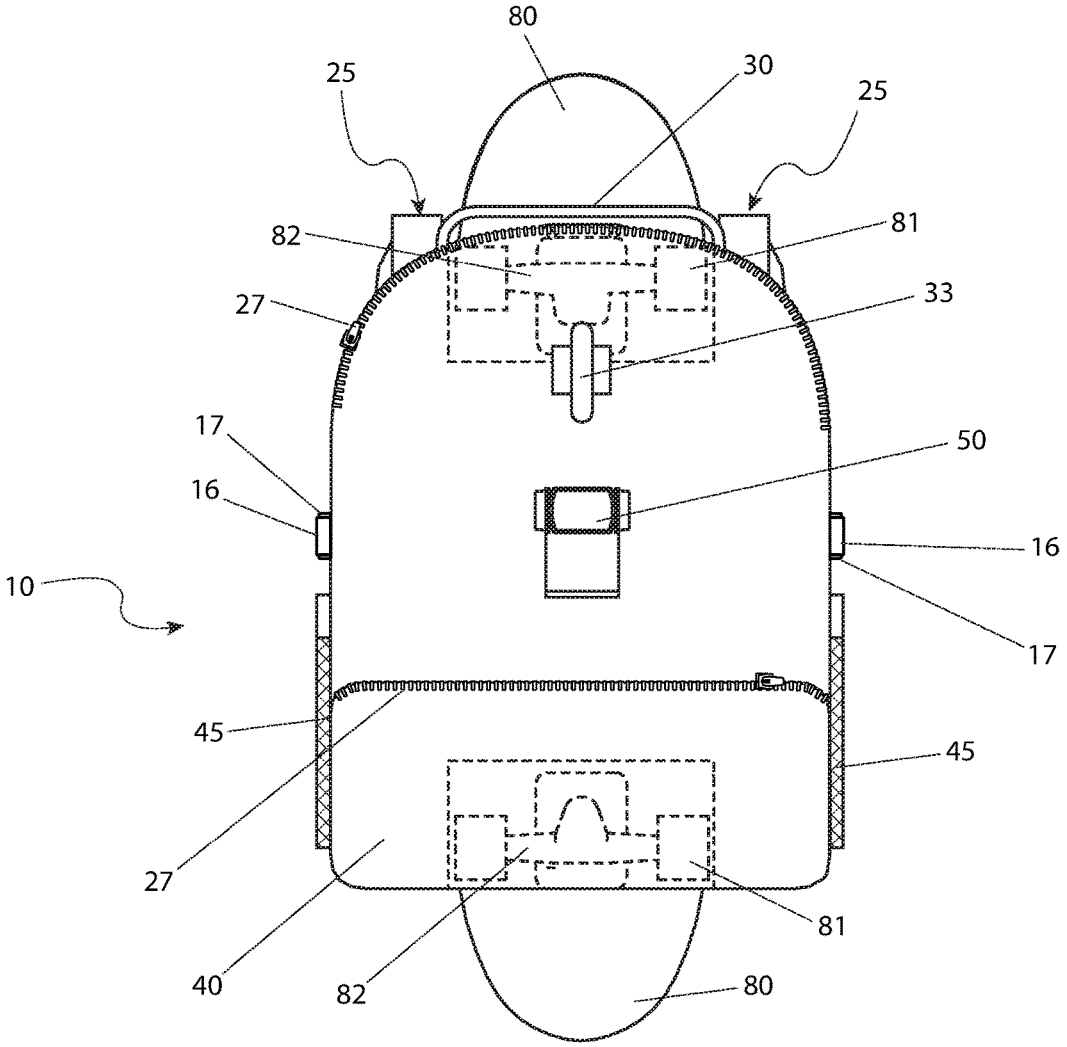
FIG. 3 is a rear view illustrating the backpack 10 holding a skateboard 80, according to an embodiment of the present invention.

Referring now to the drawings, there is shown in FIGS. 1-3, a backpack 10 capable of securing a skateboard 80 thereto. As shown, the skateboard 80 may be secured to the rear of the backpack 10. The skateboard 80 may be positioned with the wheels 81 facing away from the user 75 so as to avoid injury. The remainder of the backpack 10 may retain any additional items needed for skateboarding, along with any other items the user 75 deems necessary. The shoulder straps 25 are longer in length than a traditional backpack 10 to adapt to the span of a skateboard 80. The shoulder straps 25 are longer than conventional shoulder straps and have distal ends attached to the rear of the backpack 10. The length of the shoulder straps 25 may be twenty-two inches long by two-and-a-half inches wide (22×2½ in.) for comfort and ease of placing the backpack 10 on the user's back 75. A foam cradle pad 135 as well as a lumbar pad 150 are also depicted and will be described in greater detail herein below.

The attachment pad 20, preferably having complementary hook-and-loop-type (Velcro®-type) fasteners on outer portions thereof, are wide to assist in securing the skateboard 80 to the rear of the backpack 10 without fear of the skateboard 10 shaking loose and becoming damaged in an unexpected drop. The wheels 81 and the trucks 82 of the skateboard 80 either reside within wheel recesses 48 and truck recesses 47, respectively, formed in the upper and lower locations on the rear of the backpack 10 rest, or alternately the wheels 81 and trucks 82 can rest on top of the backpack 10 for an extra measure of stability. The rest of the backpack 10 remains accessible in order to carry the extra items, leaving the hands of the user 75 free. The attachment pad 20 may be a length of thirteen inches (13 in.) down the rear of the backpack 10, and eight inches (8 in.) wide where the skateboard 80 will be secured thereto. Other embodiments include foam inserts (not shown) for the attachment pad 20, measuring two inches by two inches (2×2 in.), which may also be hook-and-loop-type (Velcro®-type) fasteners so that the attachment pad 20 can be adjusted based on user preference. Additionally, there can be an adjustable comfort pad (not shown), capable of providing lumbar support for a lower back of the user 75.

The inside of the backpack 10 itself may contain a molded plastic bar measuring sixteen inches by three inches (16×3 in.), and will be inserted into the bottom rear of the backpack 10 for stability against the weight of the skateboard 80. It is preferred that the backpack 10 have at least one (1) compartment, accessible via a fastener such as a zipper 27, preferably accessible near the top of the backpack 10. Adjacent to the zipper 27 of each compartment, and preferably located rear of the zipper 27 access of a compartment, is a handle 30. A carabiner 32 is also present in similar locations as the handle 30, but preferably located between two (2) zipper tracks 27 of adjacent compartments.

The sides of the backpack 10, at an intermediate location, have a side strap 16 capable of laterally adjusting the width of the backpack 10, such as in instances where one (1) of the compartments is empty and the user 75 wishes to minimize the width of the backpack 10. A side strap buckle 17 is utilized to secure the desired width. Subjacent to the side strap 16 on each side is netting 45 that is attached to the backpack 10 and capable of receiving and securing items therein, such as a drinking vessel. The netting 45 may have an upper horizontal portion, or the entire netting 45 itself, may comprise elastic properties to accomplish this.

Figure 10:
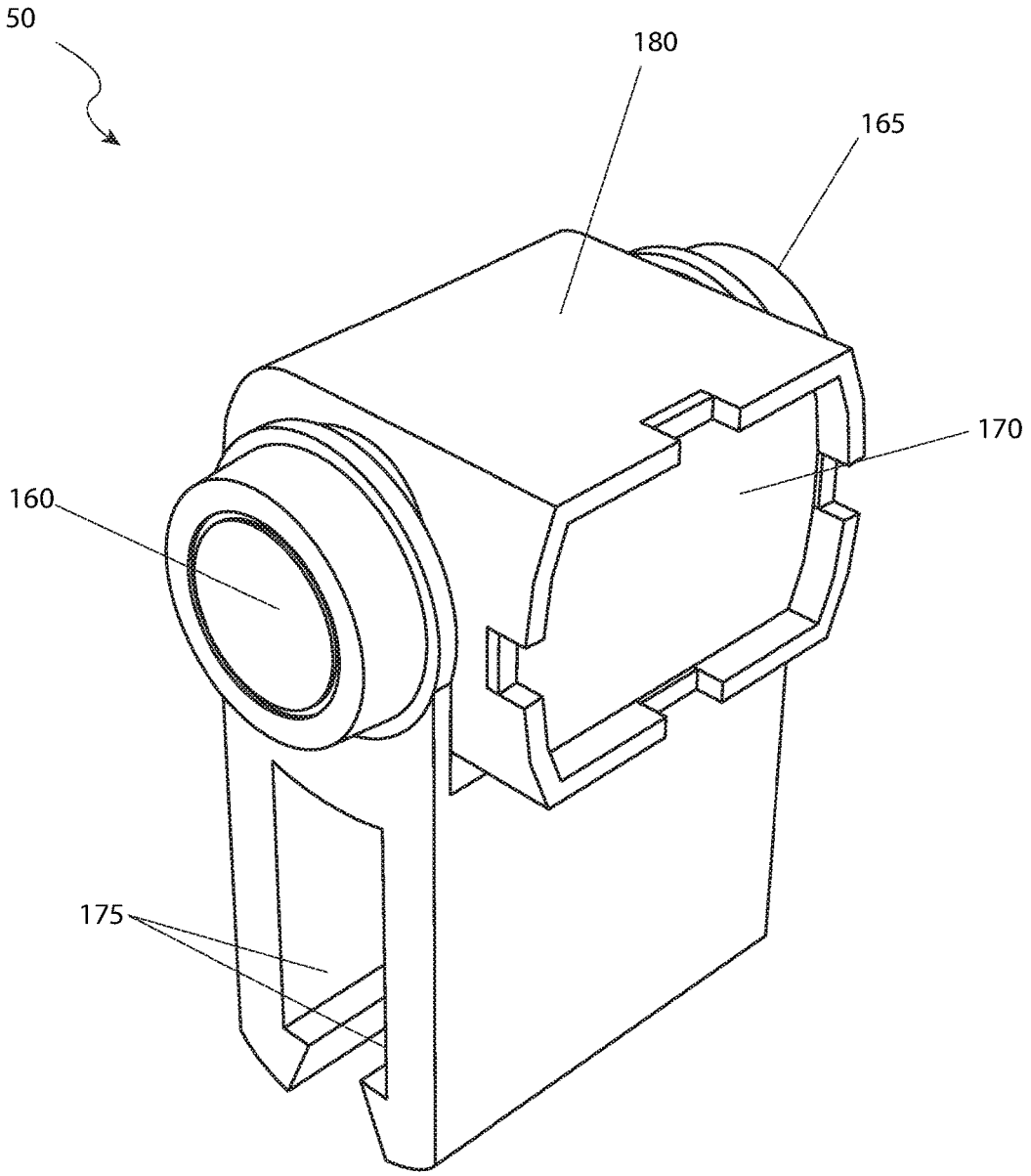

The front of the backpack has preferably a pouch compartment 40 that extends forwardly from the backpack 10 and is also accessible via a zipper 27. On the front of the backpack 10, between the zipper 27 for one (1) of the compartments and the pouch 40, is an illumination device 50 that is capable of removably attached to the backpack 10. Additionally, the illumination device 50, or an additional illumination device 50 can be removably attached to the chest strap 35. FIG. 10.

Figure 5:
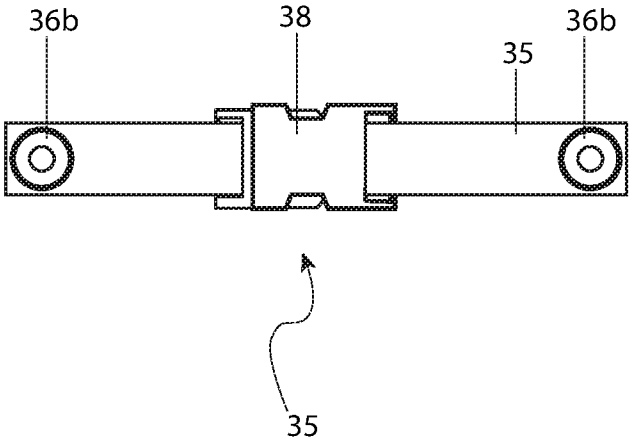
FIG. 5 is a front view illustrating a chest strap 35 and an individual shoulder strap 20, according to an embodiment of the present invention.
Figure 4:
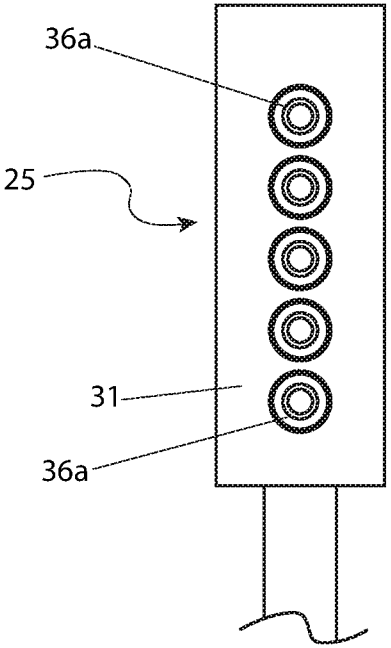
FIG. 4 is a front view illustrating a representative shoulder strap 25, according to an embodiment of the present invention.

Referring now to FIGS. 4 and 5, more detail regarding the shoulder straps 25 and chest strap 35 is described. Each shoulder strap 25 comprises a cushioned member 31 either affixed around a perimeter thereof, or enveloping the shoulder strap 25 such that it can be adjusted along a length thereof. Located along a common axial centerline on the cushioned member 31 is a plurality of lops 37. The chest strap 35 a chest strap buckle 38 centrally located. The chest strap also 35 has a pair of first fasteners **36*a*, each located adjacent to a distal end thereof, and a pair of second fasteners 36***b*, each located between an individual one (1) of the first fasteners 36*a* and the chest strap buckle 38. To secure the chest strap 35 to the shoulder straps 20, the distal ends of the chest strap 35 are routed through desired one (1) of the plurality of loops 37, doubled back on itself, and ensuring that the first fastener 36*a* is attaching to a second fasteners 36*b*.

Figure 6:
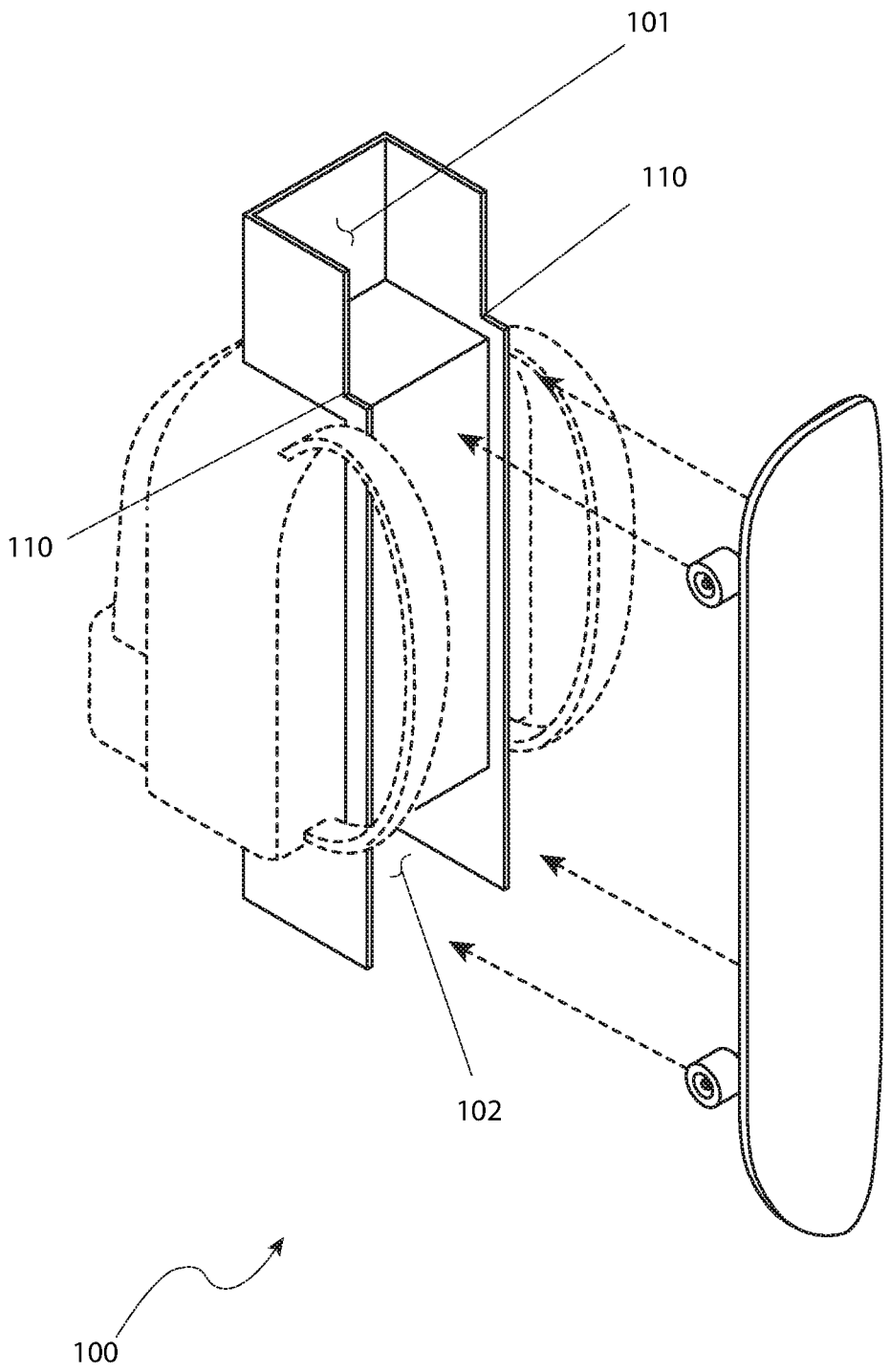
FIG. 6 is a perspective view illustrating a molded frame 100 as used with the backpack 10, according to an embodiment of the present invention.

Referring next to FIG. 6, a perspective view illustrating a molded frame 100 as used with the backpack 10, according to an embodiment of the present invention is disclosed. The molded frame 100 is envisioned to be made of impact resistant plastic in an injection molding process. This molded frame 100 is provided with an upper pocket 101 and a lower pocket 102 for accepting the truck assemblies 82 (not shown in this figure) of a skateboard 80 (not shown in this figure). The upper pocket 101 is provided with two (2) notches 110 to allow the shoulder straps 25 (as shown in FIG. 1) to pass through. The molded frame 100 is used to provide physical protection for the skateboard 80 (not shown in this FIG. 1). However, the backpack 10 may be used without the molded frame 100 (as indicated in FIG. 1), and as such, is not intended to be a limiting factor of the present invention.

Figure 7:
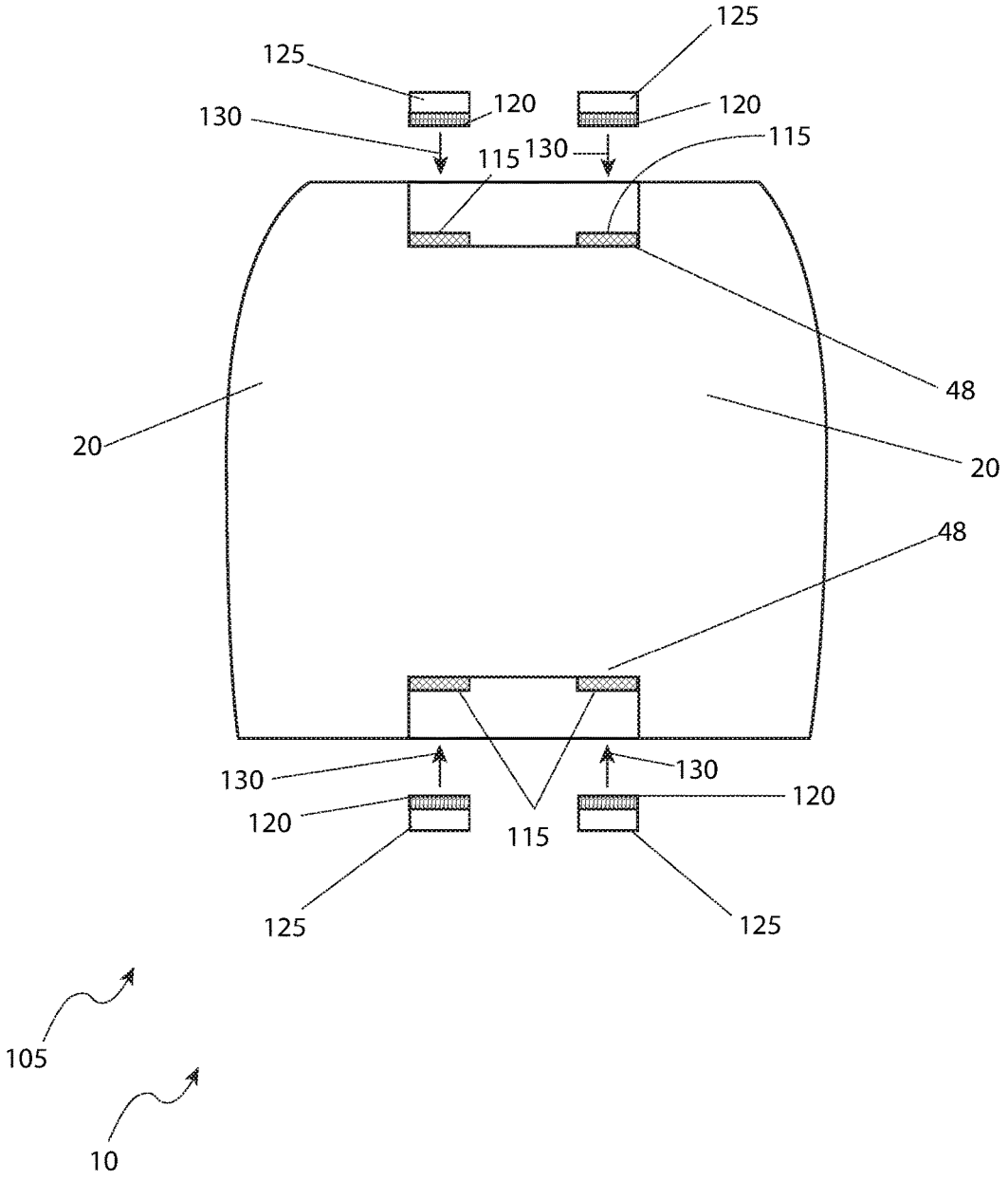
FIG. 7 is a front view illustrating a hook-and-loop wheel securement system 105 as used with the backpack 10, according to an embodiment of the present invention.

Referring now to FIG. 7, a front view illustrating a hook-and-loop wheel securement system 105 as used with the backpack 10, according to an embodiment of the present invention is depicted. As different skateboards 80 (not shown in this figure) will have different sized trucks 82 and wheels 81, the hook-and-loop wheel securement system 105 will aid in securement of the skateboard 80 as well as prohibit unwanted wheel movement. The first side of hook-and-loop fastener 115 is provided within the wheel recess 48 of the backpack 10. Hard foam spacers 125 with the second side of hook-and-loop fastener 120 are then attached the first side of the hook-and-loop fastener 115 as indicated by direction arrows 130. The first side 115 is preferably the hook side and the second side 120 is preferably the loop side. The hard foam spacers 130 are envisioned to be made available in multiple thicknesses such as one-eighth inch (⅛ in.), one-quarter inch (¼ in.), one-half inch (½ in.), and three-quarter inch (¾ in.) to suit all sizes of skateboards 80. The remaining dimensions of the hard foam fasteners 125 are envisioned to be approximately one-and-a-half by three-and-a-quarter inch (1½ by 3¼ in.).

Figure 8:
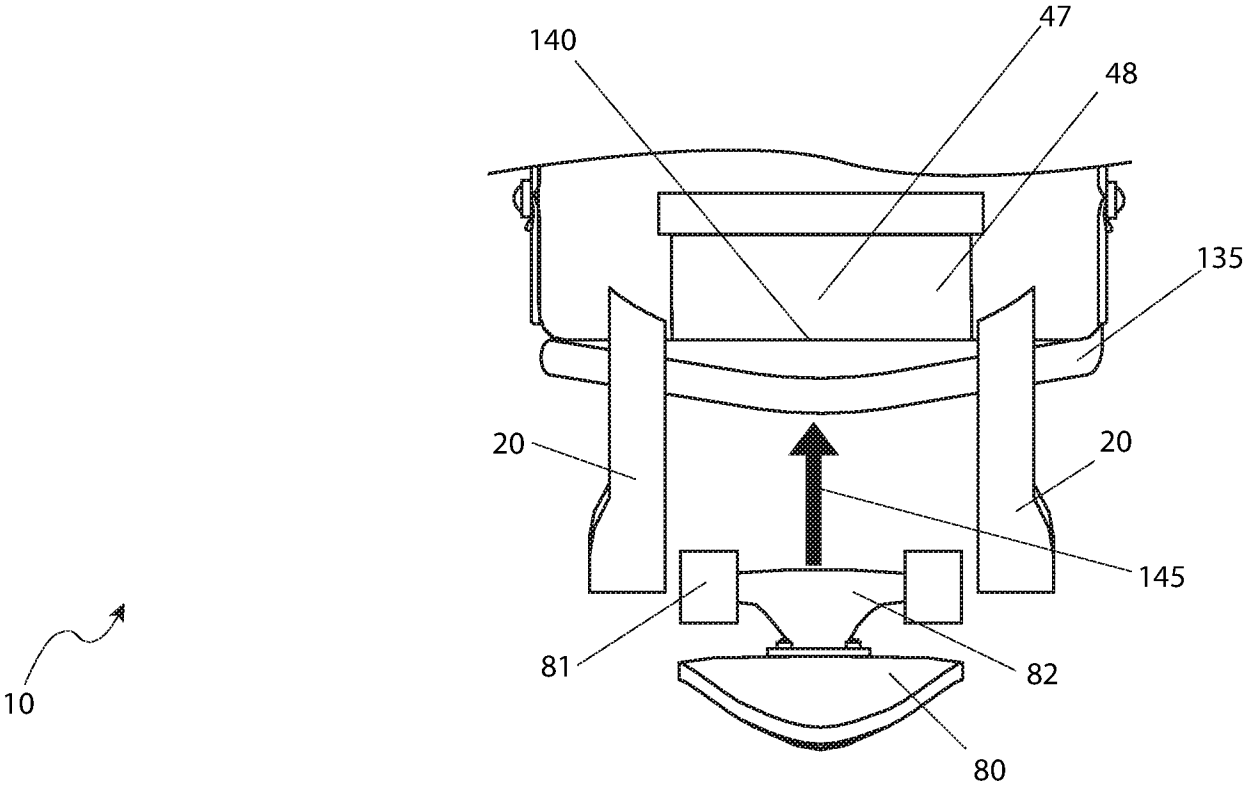
FIG. 8 is a sectional view as seen along a line I-I as seen in FIG. 2, according to an embodiment of the present invention.

Referring next to FIG. 8, a sectional view as seen along a line I-I as seen in FIG. 2, according to an embodiment of the present invention is shown. This figure provides additional disclosure regarding the attachment of the skateboard 80 as well as carrying comfort when wearing the backpack 10. A foam cradle pad 135 as well as the attachment pads 20 are covered in hook-and-loop fastener. The skateboard 80 is centered within an opening 140 as indicated by a travel path 145. It is envisioned that the thickness of the foam cradle pad 135 is approximately one inch (1 in.) thick. Once positioned, one (1) of the attachment pads 20, is folded over followed by the remaining attachment pad 20 to provide a flush surface against the wearer's back once positioned.

Figure 9:
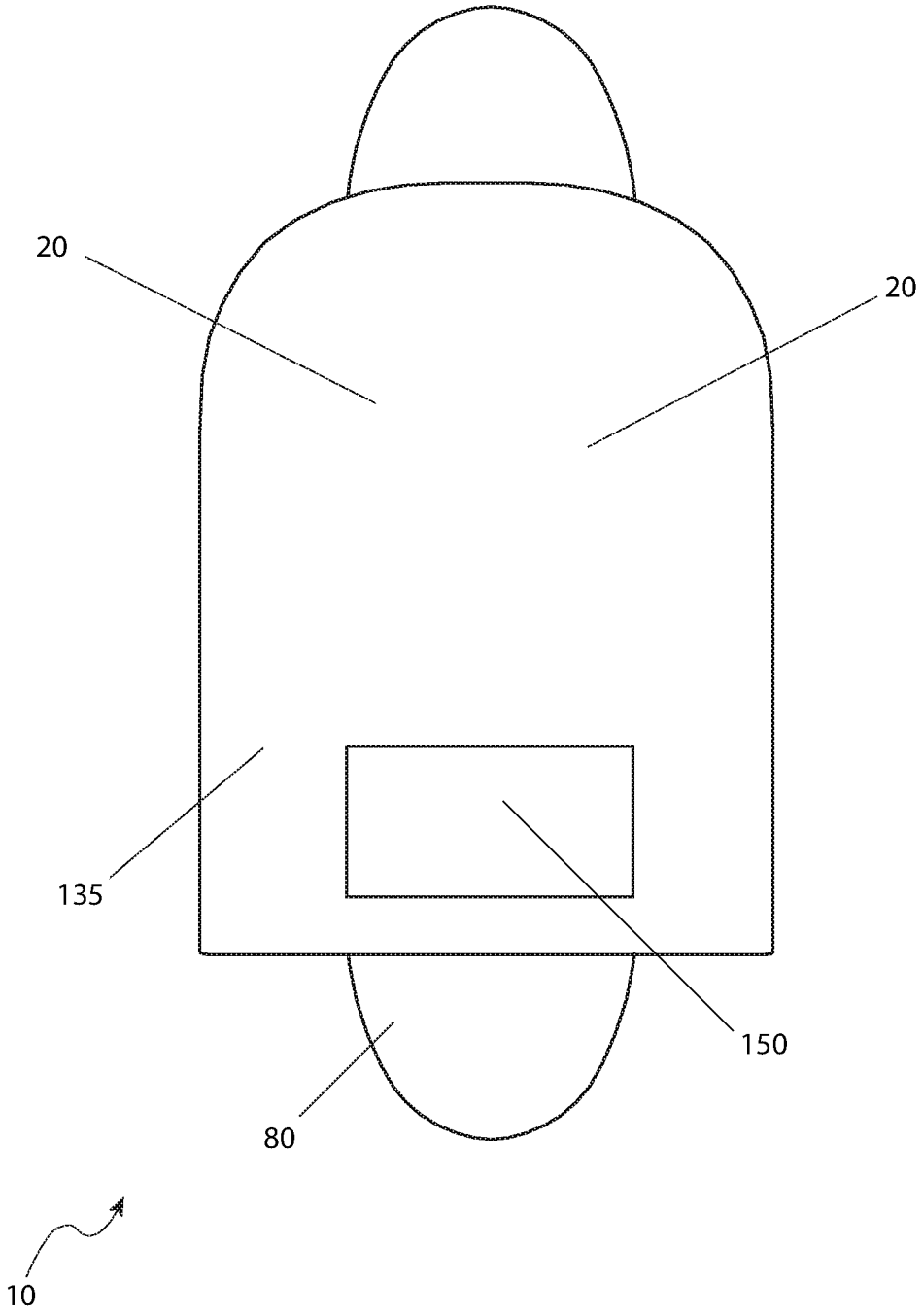
FIG. 9 is a rear view of the backpack 10, according to an embodiment of the present invention; and, FIG. 10 is a perspective top view of a light source 155 having a belt clip 175.

Referring next to FIG. 9, a rear view of the backpack 10, according to an embodiment of the present invention is disclosed. This figure discloses the skateboard 80 secured within the foam cradle pad 135 with both attachment pads 20 in the closed and secured position. As the exterior surface of the outer attachment pad 20 is covered with hook-and-loop fastener, it provides a means to secure a lumbar pad 150. The lumbar pad 150 is envisioned to be manufactured of hard foam board with an external durable padding and is approximately one inch (1 in.) thick. The rear surface of the lumbar pad 150 is covered with an opposing hook-and-loop fastener allowing it to be located at the optimum position on the external attachment pad 20. The optimum positioning is governed by multiple factors including but not limited to user size, user wearing position, size of skateboard, and the like.

Referring finally to FIG. 10, a perspective top view of an illumination device 50 having a belt clip 175, according to an embodiment of the present invention is disclosed. This figure discloses the light 170, within a housing 180 which is moveable up or down by the turning of either a first knob 160 or a second knob 165. A clip 175 is disposed beneath the light which permits the light source to be removably secured to either the chest strap 35 or the shoulder strap 25.

What is claimed is:

1. A backpack, comprising:

a backpack body having a pair of sides, a front side, a top side, a bottom side, and a rear side, and at least one compartment therein, each accessible via a backpack fastener; at least one wheel recess in an exterior of the rear side for receiving a wheel of a skateboard therein, said wheel recess having a first side of hook and loop type fastener inside of the recess;

a pair of shoulder straps each having distal ends affixed to aligned upper and lower positions on said rear side and one of said pair of sides;

a chest strap, capable of removably attaching to and spanning a distance between said pair of shoulder straps;

an attachment pad affixed to said rear side between said pair of shoulder straps, said attachment pad having a hook-and loop-type fastener on outer portions thereof said attachment pad, to assist in securing said skateboard to said rear of said backpack;

a hard foam spacer with a mating second side of hook-and-loop fastener is attached to said first side of said hook-and-loop fastener; to adjust the size of the recess to receive differently sized skateboards wherein said attachment pad is capable of enveloping and securing a skateboard against said rear side; and a handle located on said top side.

2. The backpack of claim 1, further comprising a carabiner located on said top side.

3. The backpack of claim 1, further comprising an adjustable strap located on each of said pair of sides.

4. The backpack of claim 1, further comprising an elastic netting located on each of said pair of sides.

5. The backpack of claim 1, further comprising a pouch located on said front side.

6. The backpack of claim 1, further comprising an illuminating device removably attached to said front side.

7. The backpack of claim 1, further comprising an illuminating device removably attached to said chest strap.

8. The backpack of claim 1, further comprising a foam insert capable of being placed within said attachment pad.

9. A backpack, comprising:

a backpack body having a pair of sides, a front side, a top side, a bottom side, and a rear side, and at least one compartment therein, each accessible via a backpack fastener;

a pair of wheel recesses located on opposing upper and lower locations of said rear side, each wheel recess including a first releasable fastener; a hard foam spacer with a second releasable fastener mated to the first releasable fastener, the hard foam spacer to adjust the size of the recess to receive differently sized skateboards;

a pair of truck recesses each having an extension of an individual wheel recess;

a pair of shoulder straps each having distal ends affixed to aligned upper and lower positions on said rear side and one of said pair of sides;

a chest strap, capable of removably attaching to and spanning a distance between said pair of shoulder straps;

an attachment pad affixed to said rear side between said pair of shoulder straps, said attachment pad having a plurality of complementary hook- and loop-type fasteners on outer portions thereof, to assist in securing said skateboard to said rear of said backpack without fear of said skateboard shaking loose and becoming damaged in an unexpected drop;

wherein said attachment pad is capable of enveloping and securing a skateboard against said rear side;

wherein each of said pair of wheel recesses are capable of receiving at least a portion of a wheel of said skateboard;

wherein each of said pair of truck recesses are capable of receiving at least a portion of a truck of said skateboard; and a handle located on said top side.

10. The backpack of claim 9, further comprising a carabiner located on said top side.

11. The backpack of claim 9, further comprising an adjustable strap located on each of said pair of sides.

12. The backpack of claim 9, further comprising an elastic netting located on each of said pair of sides.

13. The backpack of claim 9, further comprising a pouch located on said front side.

14. The backpack of claim 9, further comprising an illuminating device removably attached to said front side.

15. The backpack of claim 9, further comprising an illuminating device removably attached to said chest strap.

16. The backpack of claim 9, further comprising a foam insert capable of being placed within said attachment pad.

* * * * *